US011276930B2

(12) United States Patent
Zhou et al.

(10) Patent No.: US 11,276,930 B2
(45) Date of Patent: Mar. 15, 2022

(54) ANTENNA AND MOBILE TERMINAL

(71) Applicant: Huawei Technologies Co., Ltd., Shenzhen (CN)

(72) Inventors: Dawei Zhou, Beijing (CN); Yuanpeng Li, Beijing (CN); Tiezhu Liang, Beijing (CN); Gonglei Zhang, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 88 days.

(21) Appl. No.: 16/620,359

(22) PCT Filed: Dec. 27, 2018

(86) PCT No.: PCT/CN2018/124150
§ 371 (c)(1),
(2) Date: Dec. 6, 2019

(87) PCT Pub. No.: WO2019/227914
PCT Pub. Date: Dec. 5, 2019

(65) Prior Publication Data

US 2020/0106177 A1 Apr. 2, 2020

(30) Foreign Application Priority Data

Jun. 1, 2018 (CN) ..... 201810554555.9

(51) Int. Cl.
*H01Q 1/24* (2006.01)
*H01Q 1/48* (2006.01)
*H01Q 5/10* (2015.01)

(52) U.S. Cl.
CPC ..... *H01Q 5/10* (2015.01); *H01Q 1/24* (2013.01); *H01Q 1/48* (2013.01)

(58) Field of Classification Search
CPC .. H01Q 5/10; H01Q 1/24; H01Q 1/48; H01Q 9/04; H01Q 5/335; H01Q 1/243; H01Q 5/364; H01Q 1/44; H01Q 5/378
(Continued)

(56) References Cited

U.S. PATENT DOCUMENTS

2008/0284670 A1 11/2008 Kanno et al.
2014/0078008 A1* 3/2014 Kang ..... H01Q 1/38 343/702

(Continued)

FOREIGN PATENT DOCUMENTS

CN 203503779 U 3/2014
CN 105449349 A 3/2016

(Continued)

*Primary Examiner* — Hai V Tran
(74) *Attorney, Agent, or Firm* — Conley Rose, P.C.

(57) ABSTRACT

An antenna disposed on a mobile terminal, where the mobile terminal includes a radiation portion and a circuit board, the circuit board includes a lateral side and a grounding layer, and an insulating slot divides the radiation portion into a feed stub and a parasitic stub. A gap is encompassed by the circuit board and the radiation portion. There is a first branch that extends from the feed stub to the gap for feeding the antenna, and there is a second branch that extends from the parasitic stub to the gap and that is electrically connected to a grounding portion. The antenna excites a current loop winding around the gap on the grounding portion, the feed stub, and the parasitic stub.

20 Claims, 13 Drawing Sheets

(58) Field of Classification Search
USPC ..... 343/846
See application file for complete search history.

(56) References Cited

U.S. PATENT DOCUMENTS

| | | | | |
|---|---|---|---|---|
| 2014/0266922 | A1* | 9/2014 | Jin | H01Q 5/314 343/702 |
| 2015/0109182 | A1 | 4/2015 | Chen et al. | |
| 2015/0255854 | A1 | 9/2015 | Lin et al. | |
| 2015/0349404 | A1* | 12/2015 | Wang | H01Q 5/314 343/702 |
| 2016/0064820 | A1* | 3/2016 | Kim | H01Q 7/00 343/767 |
| 2016/0164168 | A1* | 6/2016 | Choi | H01Q 1/243 343/702 |
| 2017/0047639 | A1* | 2/2017 | Lee | H01Q 1/243 |
| 2017/0279199 | A1 | 9/2017 | An et al. | |
| 2017/0324151 | A1 | 11/2017 | Mai | |
| 2017/0346159 | A1* | 11/2017 | Xue | H01Q 5/314 |
| 2018/0123234 | A1* | 5/2018 | Wang | H01Q 9/42 |
| 2018/0254541 | A1 | 9/2018 | Xiong | |

FOREIGN PATENT DOCUMENTS

| | | | |
|---|---|---|---|
| CN | 105655689 | A | 6/2016 |
| CN | 105762492 | A | 7/2016 |
| CN | 105977634 | A | 9/2016 |
| CN | 106207446 | A | 12/2016 |
| CN | 106384870 | A | 2/2017 |
| CN | 106571516 | A | 4/2017 |
| CN | 106848594 | A | 6/2017 |
| CN | 106876976 | A | 6/2017 |
| CN | 106876979 | A | 6/2017 |
| CN | 107230835 | A | 10/2017 |
| CN | 107275761 | A | 10/2017 |
| CN | 107293838 | A | 10/2017 |
| CN | 107437661 | A | 12/2017 |
| CN | 107611565 | A | 1/2018 |
| JP | 2015167292 | A | 9/2015 |
| JP | 2016111669 | A | 6/2016 |
| KR | 20150110783 | A | 10/2015 |
| KR | 20160027700 | A | 3/2016 |

* cited by examiner

ANTENNA AND MOBILE TERMINAL

CROSS-REFERENCE TO RELATED APPLICATIONS

This application is a U.S. National Stage of International Patent Application No. PCT/CN2018/124150 filed on Dec. 27, 2018, which claims priority to Chinese Patent Application No. 201810554555.9 filed on Jun. 1, 2018. The disclosures of the aforementioned applications are hereby incorporated by reference in their entireties.

TECHNICAL FIELD

This application relates to the communications field, and in particular, to an antenna and a mobile terminal including the antenna.

BACKGROUND

Most of current mobile terminals have a call function, and are internally provided with antennas used to communicate with the outside. When a user makes a call, a mobile terminal is usually in a head-hand mode, and antenna signal attenuation is relatively serious when the mobile terminal is in the head-hand mode, affecting a call effect of the mobile terminal.

SUMMARY

An objective of this application is to provide an antenna that can still maintain relatively good signal sending and receiving performance in a head-hand mode. The following technical solutions are included:

An antenna is provided, and includes a feed stub, a parasitic stub, a feed branch, a grounding branch, and a grounding portion. The antenna apparatus is disposed in a mobile terminal, the mobile terminal includes a radiation portion and a circuit board, the circuit board includes a lateral side, the grounding portion is disposed on the whole or a part of a grounding layer on the circuit board, the lateral side is located on an edge of the grounding portion, a gap is formed between the radiation portion and the lateral side, the radiation portion is provided with an insulating slot, the insulating slot divides the radiation portion into the feed stub and the parasitic stub, the feed branch extends from the feed stub to the gap, an end that is of the feed branch and that is far away from the feed stub is a feed point, the grounding branch extends from the parasitic stub to the gap and is electrically connected to the grounding portion, the lateral side is located between an end that is of the feed stub and that is far away from the insulating slot and an end that is of the parasitic stub and that is far away from the insulating slot, and the end that is of the feed stub and that is far away from the insulating slot and the end that is of the parasitic stub and that is far away from the insulating slot both are electrically connected to the grounding portion.

Specifically, a resonance generated by the antenna on the grounding portion, the feed stub, and the parasitic stub excites an induced current loop winding around the gap.

According to the antenna in this application, the gap is encompassed by the radiation portion and the lateral side, the insulating slot divides the radiation portion into the feed stub and the parasitic stub, and the feed branch and the grounding branch are respectively extended in a direction in which the feed stub faces the gap and in a direction in which the parasitic stub faces the gap. The end that is of the feed branch and that is far away from the feed stub is the feed point, configured to conduct a radio frequency signal. An end that is of the grounding branch and that is far away from the parasitic stub is electrically connected to the grounding portion, to maintain a zero potential of the grounding branch. When the feed point starts feeding the antenna, the feed branch is coupled to the grounding branch, and an induced current extending in a length direction of the gap is excited on the lateral side. The current passes through the lateral side, the feed stub, and the parasitic stub to form a current loop cycling around the gap. The feed branch and the grounding branch may form a resonance to the current at a position having a relatively large induced current, so that radiation power of the antenna is enlarged, thereby improving signal sending and receiving performance of the antenna.

A transmit frequency of the antenna includes a low frequency band of 617 MHz to 960 MHz, and further includes LTE and GPS frequency bands close to low frequencies, such as an LTE B11/21/32 frequency band (1427 MHz to 1511 MHz) and a GPS L1/L2/L5 frequency band (1575.42 MHz/1227.6 MHz/1176.45 MHz).

The grounding portion, the feed stub, and the parasitic stub jointly constitute an electrical length that is a half of a wavelength of an operating frequency of the antenna, so that the resonance that is generated by the grounding portion, the feed stub, and the parasitic stub excites the induced current that winds around the gap and that has a relatively large value, thereby helping improve radiation efficiency.

A size range of the insulating slot in the length direction of the radiation portion is greater than or equal to 0.2 mm and less than or equal to 2 mm, to ensure that the feed stub is coupled to the parasitic stub. The length direction of the radiation portion is a direction in which the radiation portion extends from the feed stub to the parasitic stub.

The coupling between the feed branch and the grounding branch may be further adjusted through a capacitance generated by two parallel planes formed by the insulating slot.

The insulating slot further includes a conductive suspension section, the suspension section is located between the feed stub and the parasitic stub, and an insulating separation slot is separately disposed between the suspension section and the feed stub and between the suspension section and the parasitic stub. The suspension section may be used to arrange structures such as a key or an interface of the mobile terminal.

Relative to a grounding point of the feed stub, the feed branch is closer to an end of the insulating slot on the feed stub, and relative to the grounding point of the feed stub, the grounding branch is closer to the end of the insulating slot on the parasitic stub. Specifically, a first distance is less than a second distance, and a third distance is less than a fourth distance. The first distance is a distance between the insulating slot and a portion that connects the feed branch and the feed stub. The second distance is a distance between the portion that connects the feed branch and the feed stub and a position at which the feed stub is electrically connected to the grounding portion. The third distance is a distance between the insulating slot and a portion that connects the grounding branch and the parasitic stub. The fourth distance is a distance between the portion that connects the grounding branch and the parasitic stub and a position at which the parasitic stub is electrically connected to the grounding portion. A midpoint position of the lateral side is a position having a largest induced current, and after the suspension section is added, the feed branch and the grounding branch are close to each other, thereby implementing a better coupling effect.

A size range of the suspension section in the length direction of the radiation portion is greater than or equal to 12 mm and less than or equal to 18 mm. A size range of the separation slot in the length direction of the radiation portion is greater than or equal to 0.2 mm and less than or equal to 1.5 mm. This setting may match most keys or interfaces, and the coupling between the grounding branch and the feed branch is ensured.

A range of a length by which the feed branch extends to the gap is greater than or equal to ⅙ of the wavelength of the operating frequency of the antenna, and less than or equal to ⅛ of the wavelength of the operating frequency of the antenna. A length by which the grounding branch extends to the gap is ¼ of the wavelength of the operating frequency of the antenna, so that efficient coupling between the grounding branch and the feed branch can be further ensured.

A parasitic frequency modulation apparatus is disposed between the grounding branch and the grounding portion, and is configured to adjust a frequency of the grounding branch.

The feed branch is further provided with a feed frequency modulation branch, the feed frequency modulation branch is located in a direction in which the parasitic stub extends towards the feed stub, the feed frequency modulation branch also extends towards the gap, and the feed frequency modulation branch is electrically connected to the grounding portion. The feed frequency modulation branch may be configured to ground the feed stub.

A feed frequency modulation apparatus is further disposed between the feed frequency modulation branch and the grounding portion, and the feed frequency modulation apparatus is configured to adjust a frequency of the feed stub.

The lateral side includes a first segment and a second segment that intersect with each other. The feed stub or the parasitic stub bends synchronously along with the lateral side, to ensure a consistent cross-sectional width of the gap in the length direction. To be specific, the feed stub or the parasitic stub also includes two intersected shapes. A length of the gap may be extended by a combination of the first segment and the second segment, so that a matching range of the wavelength of the antenna is enlarged.

The lateral side further includes a third segment, the first segment is connected between the second segment and the third segment, the third segment intersects with the first segment, and the second segment and the third segment bend in a same direction from the first segment. The feed stub bends synchronously along with the third segment, and the parasitic stub bends synchronously along with the second segment. To be specific, the feed stub and the parasitic stub both include two intersected shapes. The third segment may be used to further extend the length of the gap, and cooperate with the first segment and the second segment to adjust a position of the insulating slot on the mobile terminal.

The third segment and the second segment are distributed symmetrically on two ends of the first segment, and the parasitic stub and the feed stub are distributed symmetrically on two sides of the insulating slot. A length of the third segment is equal to that of the second segment, so that the insulating slot is located at a center position of a frame on a side of the mobile terminal.

This application further relates to a mobile terminal, including a transceiver and the foregoing antenna. The transceiver is electrically connected to a feed point in the antenna, and the transceiver exchanges data with the outside through the antenna. It can be understood that the mobile terminal may implement a better call effect by using the antenna.

The lateral side is located at a bottom end of the mobile terminal, a short side close to a position at which an earpiece is disposed in the mobile terminal is a top end of the mobile terminal, and a position of the lateral side helps expose the antenna and avoid covering in a call status.

DESCRIPTION OF EMBODIMENTS

The technical solutions in this application are described below with reference to the accompanying drawings in the embodiments of this application. Apparently, the described embodiments are merely some but not all of the embodiments of this application. All other embodiments obtained by a person of ordinary skill in the art based on the embodiments of this application without creative efforts shall fall within the protection scope of this application.

The mobile terminal in implementations of this application may be any device having a communication function, for example, an intelligent device having a network function such as a tablet computer, a mobile phone, an e-reader, a remote control, a notebook computer, a vehicle-mounted device, a web television, or a wearable device. It can be understood that various mobile terminals are usually provided with wireless communication functions such as cellular (Cellular), a wireless local area network (WLAN), and Bluetooth (Bluetooth) based on a functional requirement. Therefore, the mobile terminal is internally provided with an antenna configured to communicate with the outside.

Figure 1:
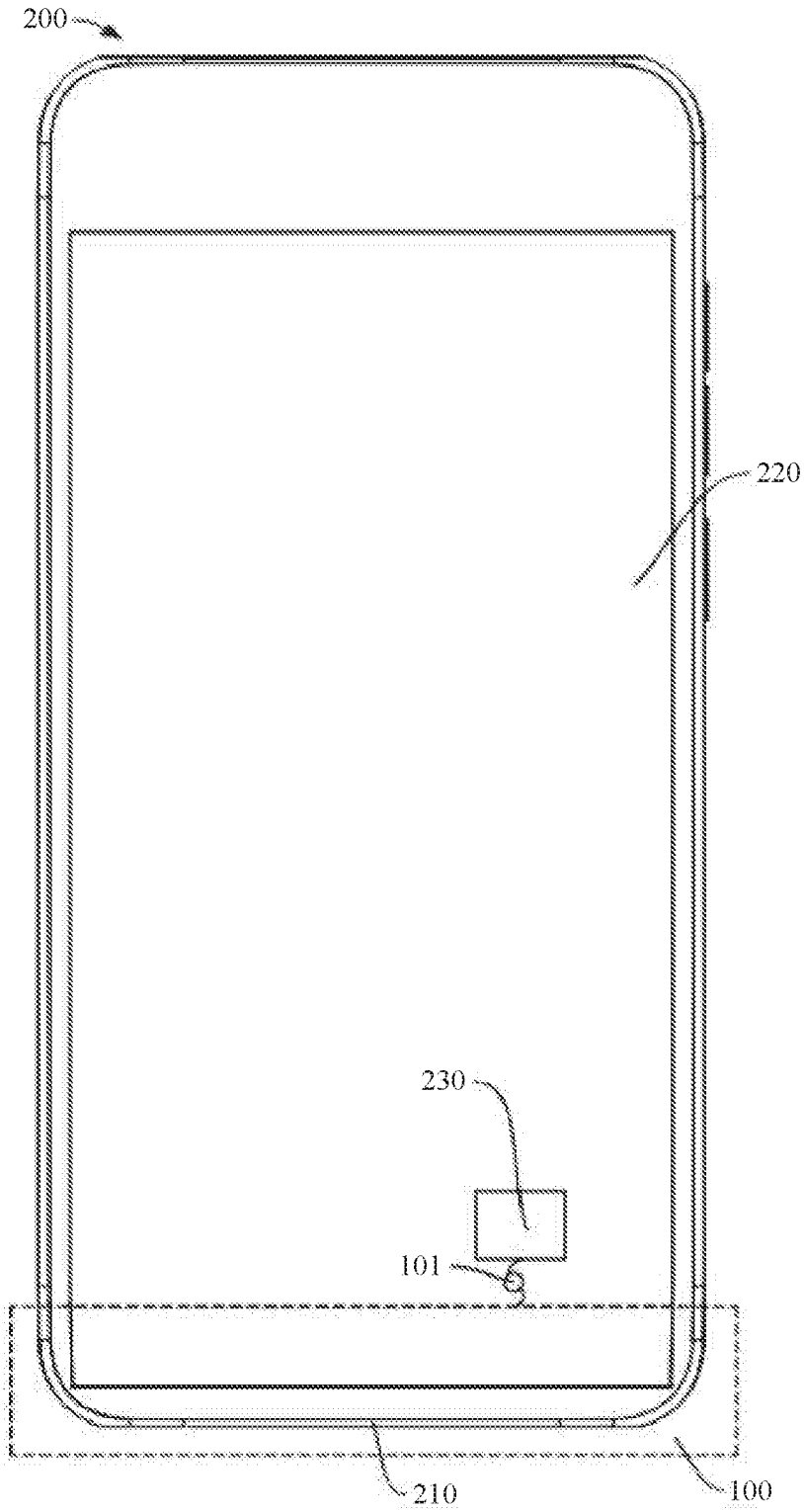
FIG. 1 is a schematic diagram of a mobile terminal according to this application.

Referring to FIG. 1, a mobile terminal 200 includes a radiation portion 210, a circuit board 220, a transceiver 230, and an antenna 100. A part of the radiation portion 210 and a part of the circuit board 220 jointly constitute a body of the antenna 100. The radiation portion 210 may be a frame of the mobile terminal 200, or may be a metal rear cover of the mobile terminal 200. When the radiation portion 210 is the frame, for example, in an embodiment shown in FIG. 1, a bottom part of the frame and an edge of the circuit board 220 jointly constitute the body of the antenna 100. When the radiation portion 210 is the metal rear cover, a metal belt similar to a frame may be formed on an edge of the metal rear cover by providing a slot, and similarly the metal belt and the edge of the circuit board 220 jointly constitute the body of the antenna 100.

The antenna 100 includes a feed point 101, and the transceiver 230 is electrically connected to the feed point 101 in the antenna 100. Therefore, when the antenna 100 operates, the transceiver 230 exchanges data with the outside through the antenna 100. Specifically, the transceiver 230 is a radio frequency transceiver circuit and is configured to feed an electromagnetic wave signal to the antenna 100.

Figure 2:
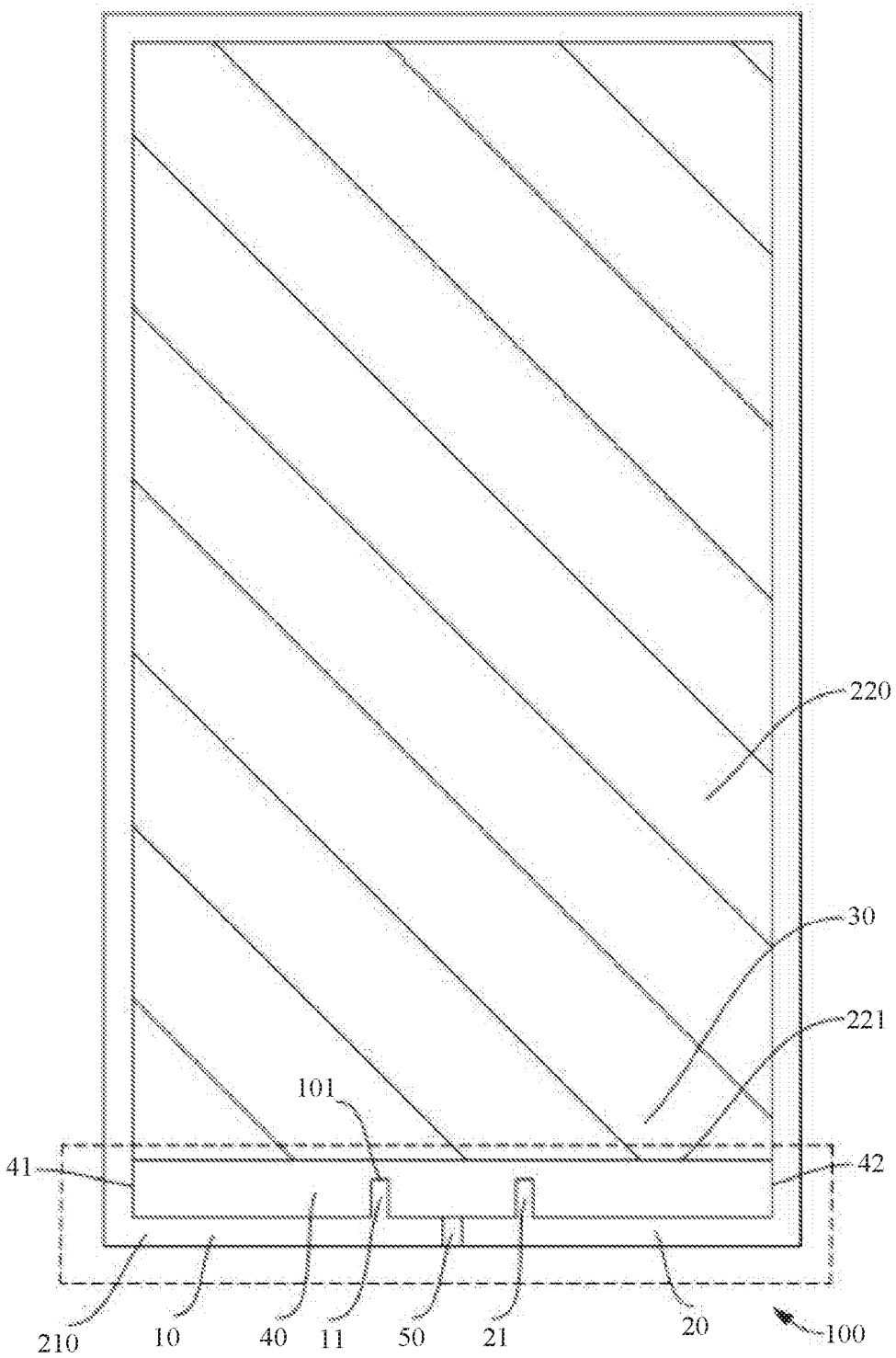
FIG. 2 is a schematic diagram of an antenna according to this application.

Specifically, referring to FIG. 2, the antenna 100 includes a feed stub 10, a parasitic stub 20, a feed branch 11, a grounding branch 21, and a grounding portion 30. The circuit board 220 of the mobile terminal 200 includes a lateral side 221. The radiation portion 210 may be a part of a metal housing (including a frame and a rear cover) of the mobile terminal 200. For example, the radiation portion 210 is a part of the frame, or the radiation portion 210 may be a part close to an edge on the metal rear cover, and has a position close to that of the frame. A gap 40 is disposed between the radiation portion 210 and the lateral side 221. The circuit board 220 includes a grounding layer, and two ends of the radiation portion 210 on the lateral side 221 are separately connected to the grounding layer. The grounding layer in the circuit board 220 constitutes the grounding portion 30 of the antenna 100. It can be understood that a connection between the radiation portion 210 and the grounding portion 30 also enables the gap 40 to form a closed-loop structure. The radiation portion 210 is provided with an insulating slot 50. The insulating slot 50 divides the radiation portion 210 into the feed stub 10 and the parasitic stub 20. Therefore, for the antenna 100, a body structure of the antenna 100 includes the grounding portion 30 located inside the lateral side 221, the feed stub 10, and the parasitic stub 20. The feed stub 10 and the parasitic stub 20 are divided by the insulating slot 50. The gap 40 is encompassed by the feed stub 10, the parasitic stub 20, and the lateral side 221. It can be understood that the gap 40 may be considered as a clearance area of the antenna 100.

The feed branch 11 is further disposed on the feed stub 10. The feed branch 11 extends from the feed stub 10 to the gap 40. An end that is of the feed branch 11 and that is far away from the feed stub 10 is the feed point 101 of the antenna 100, and the end that is of the feed branch 11 and that is far away from the feed stub 10 may extend to the inside of the circuit board 220, and feeds the feed branch 11 through a feed circuit disposed on the circuit board 220. A grounding branch 22 extending to the gap 40 is further disposed on the parasitic stub 20. The grounding branch 22 is electrically connected to the grounding portion 30. An end that is of the grounding branch 22 and that is far away from the parasitic stub 20 may extended to the inside of the circuit board 220, and the grounding branch 22 may be electrically connected to the grounding portion 30 through a grounding spring or may be electrically connected to the grounding portion 30 in a manner of welding.

Figure 3:
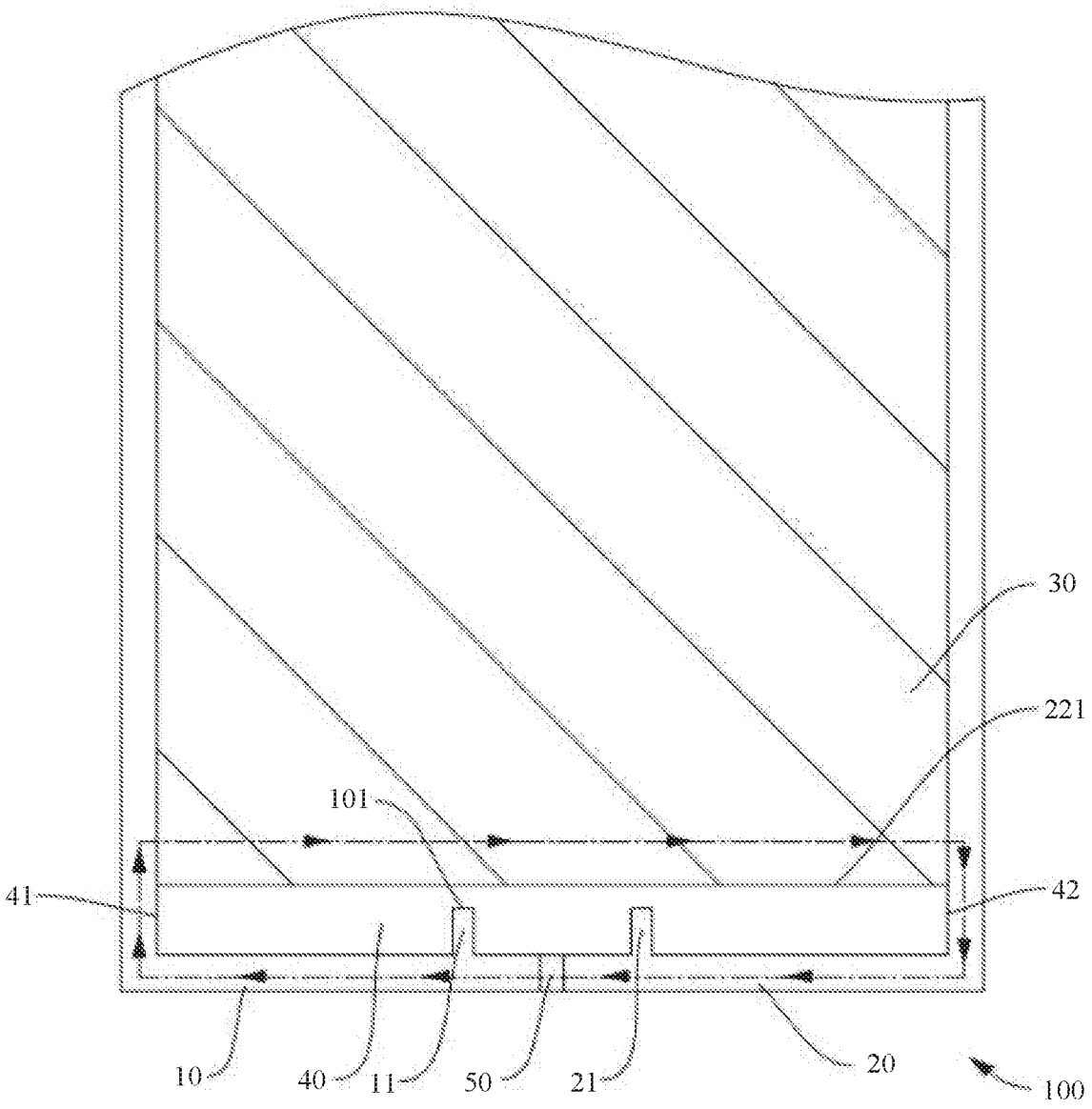
FIG. 3 is a schematic diagram of a current flow direction of the antenna shown in FIG. 2.

During feeding at the feed point 101, a current is generated on the feed branch 11 and a low-frequency resonance stub is formed. Because the feed branch 11 is connected to the feed stub 10, the feed stub 10 is also loaded with a feeding current. In addition, the feeding current is the smallest at the insulating slot 50, and is the largest at a position at which the feed stub 10 is connected to the grounding portion 30. Because the current is the smallest and an electric field is strongest at the insulating slot 50, the current may be coupled to the parasitic stub 20. The current on the parasitic stub 20 is also the smallest at the insulating slot 50, and is the largest at a position at which the parasitic stub 20 is connected to the grounding portion 30. The feed branch 11 includes a resonance because of the feeding current, and the grounding branch 21 includes a parasitic resonance because of a parasitic current. In this design, when the antenna 100 operates in a low frequency, two approximate resonance frequencies are distributed on the left and right of the insulating slot 50. The two resonance frequencies are designed through strong electric field coupling, and an induced current is excited at the grounding portion 30 after the feed branch 11 and the grounding branch 21 are coupled. The induced current passes through the grounding portion 30, the feed stub 10, and the parasitic stub 20 successively. To be specific, the induced current circulates around the gap 40 (refer to FIG. 3). A frequency of the induced current excited at the grounding portion 30 after the feed branch 11 and the grounding branch 21 are coupled is a frequency of a signal transmitted by the radiation portion 210 to the outside.

Figure 4:
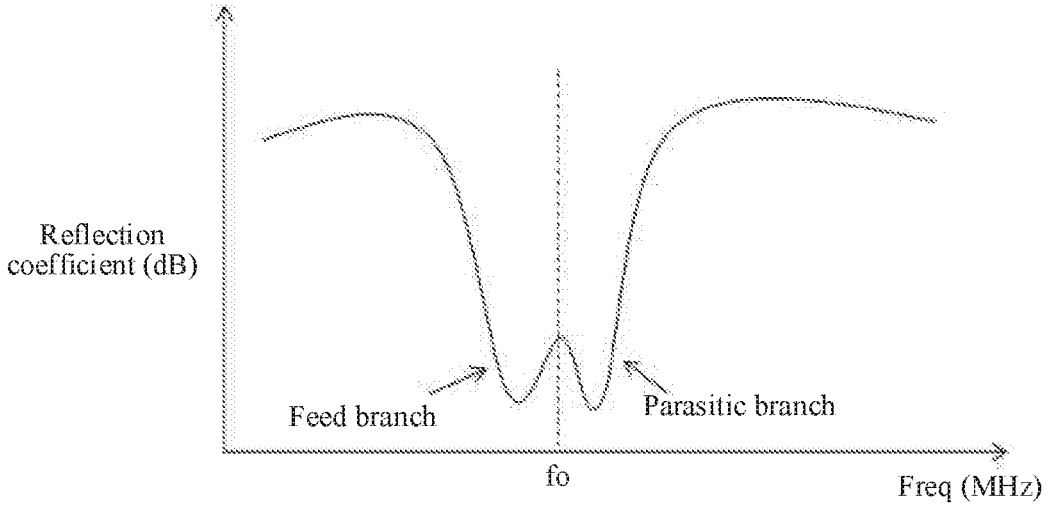
FIG. 4 is a schematic diagram of resonant coupling inside an antenna according to this application.

Referring to FIG. 4, in FIG. 4, a lateral axis represents a frequency measured in MHz, and a longitudinal axis represents a reflection coefficient (reflection coefficient) of the antenna measured in dB. It can be understood that an antenna bandwidth is a bandwidth of a frequency whose reflection coefficient is less than −6 dB. For two approximate resonance frequencies, a resonance frequency of a resonance generated by the feed branch 10 is 890 MHz, a resonance frequency of a resonance generated by the parasitic stub 20 is 970 MHz, and a frequency connected between the two resonances is 930 MHz.

It should be noted that the induced current excited at the grounding portion 30 after the feed stub 10 and the parasitic stub 20 are coupled is parallel to the gap 40, or is described as an induced current parallel to the lateral side 221. In the prior art, the feed stub 10 is not coupled to the parasitic stub 20 (refer to FIG. 5), and a low-frequency operating principle of an antenna 1000 in the prior art is as follows: A feed point 1001 excites, on a grounding portion 300, an induced current that vertically flows to a lateral side 2021 and that gathers towards the feed point 1001. The current on the grounding portion 300 is the largest at the feed point 1001, and the induced current is smaller when being farther away from the feed point 1001. Provided that an antenna clearance and an antenna form are given, a resonance and efficiency of the antenna 1000 in the prior art depend on a length and a size of the grounding portion 300 perpendicular to the lateral side 2021. To be specific, an antenna resonance having an unbalanced ½ wavelength include both a size of the grounding portion 300 perpendicular to the lateral side 2021 and a size of a feed stub of a radiation portion 2100.

Figure 6:
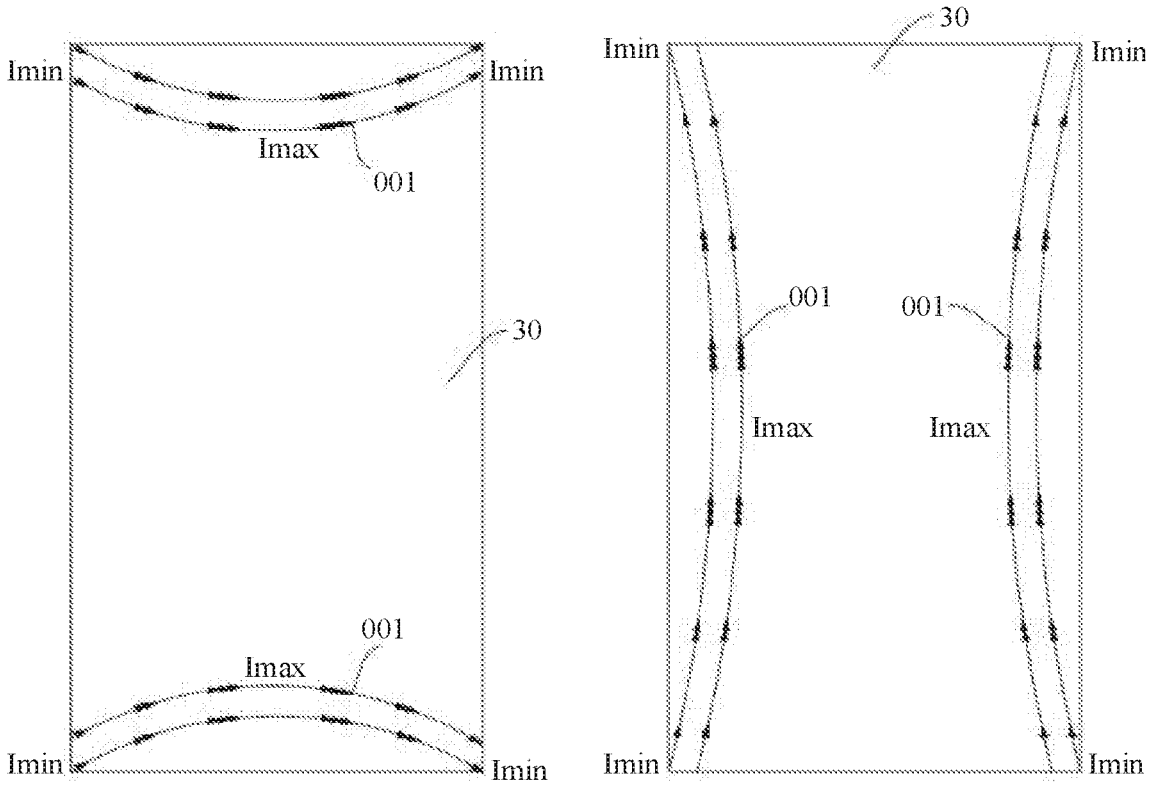
FIG. 6 is a schematic diagram of a characteristic current on a typical circuit board according to this application.

A current mode of coupling exciting of the antenna 100 provided in the embodiments of this application on the feed stub 10 and the parasitic stub 20 is a first current mode 001 shown in FIG. 6. FIG. 6 shows a strength distribution manner of a characteristic current of the antenna 100 in the first current mode 001. The grounding portion 30 is of a rectangular shape. The left of FIG. 6 is current distribution of the characteristic current on a short side of the grounding portion 30, and the right of FIG. 6 is current distribution of the characteristic current on a long side of the grounding portion 30. It can be found that, in the first current mode 001, regardless of whether the lateral side 221 is located on the long side or the short side of the grounding portion 30, the characteristic current on the grounding portion 30 always appears in a shape of being the largest in the middle and being the smallest at two ends.

Figure 5:
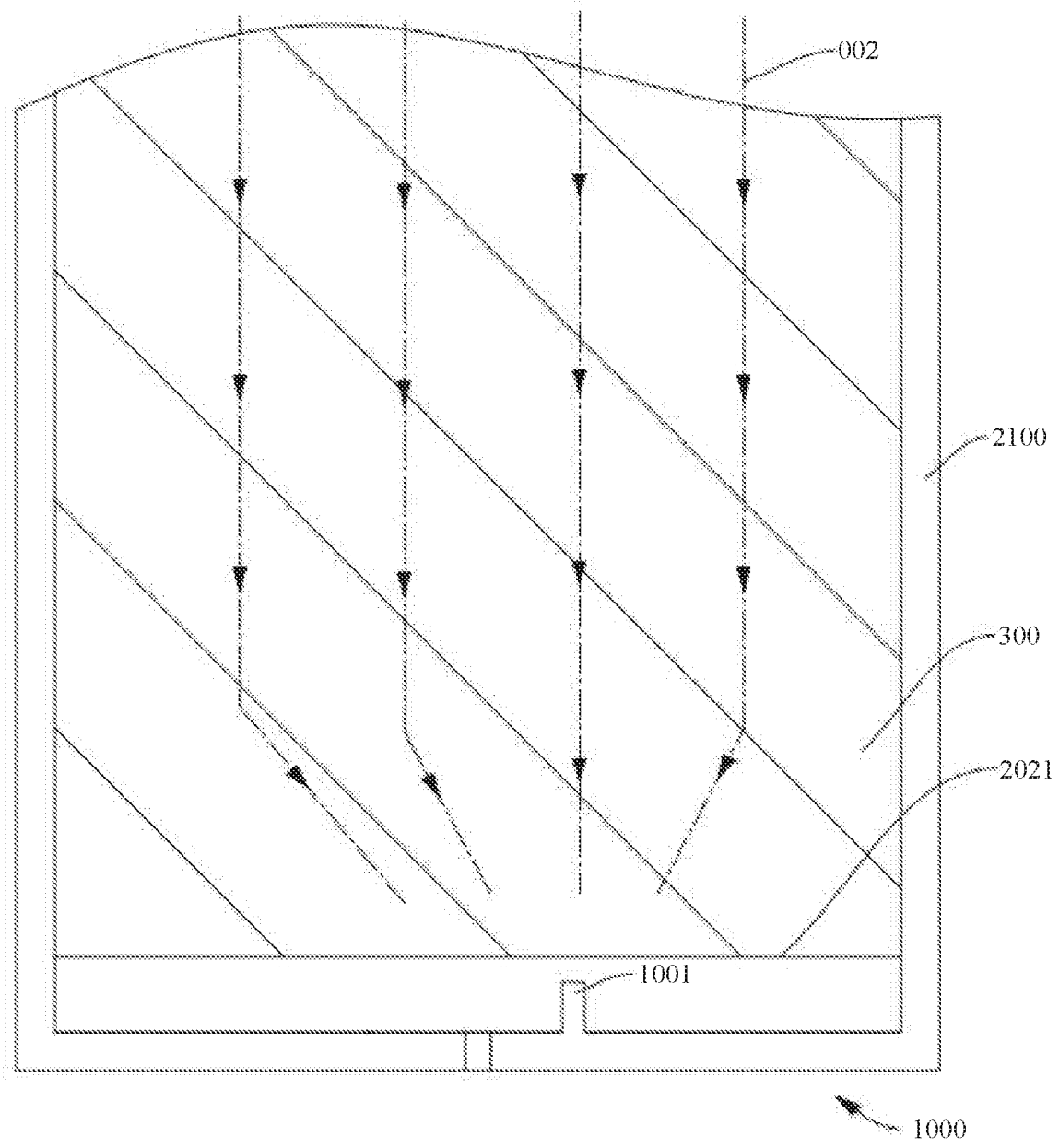
FIG. 5 is a schematic diagram of a current flow direction of an antenna in the prior art.

FIG. 5 shows a strength distribution manner of a characteristic current of the antenna in a second current mode 002 in the prior art, that is, a case in which a current direction of the antenna 1000 is perpendicular to the lateral side in the prior art. With reference to a status of feed exciting performed on the grounding portion 300 by the feed point 1001 in the gap 400, it can be learned that, in the second current mode 002 in which the current direction is perpendicular to the lateral side 2021, exciting performed on the grounding portion 300 by the feed point 1001 is just located at a position having a weakest characteristic current in the second current mode 002. Consequently, the antenna 1000 does not form most effective exciting on the grounding portion 300 in the prior art, making excited low-frequency efficiency relatively poor, and a clearance area between an antenna stub and the grounding portion of the antenna usually needs to be enlarged for compensation.

Therefore, according to distribution of a characteristic current of a feature model of the grounding portion 30 according to this application, if a low frequency of the grounding portion 30 needs to be excited mostly effectively, a point having a largest characteristic current on the grounding portion 30 needs to be excited. To be specific, an exciting source of the antenna 100 needs to be located in an area of a point having largest current distribution in a current mode corresponding to the grounding portion 30 for exciting. In the antenna 100 according to this application, the gap 40 is encompassed by the radiation portion 210 and the lateral side 221 in the antenna 100, and the insulating slot 50 divides the radiation portion 210 into the feed stub 10 and the parasitic stub 20. It is considered as a current circulation path of the antenna 100. Further, in the antenna 100 according to this application, the feed branch 11 and the grounding branch 21 extend into the gap 40 from the feed stub 10 and the parasitic stub 20 separately. An end that is of the feed branch 11 and that is far away from the feed stub 10 is the feed point 101, and an end that is of the grounding branch 21 and that is far away from the parasitic stub 20 is electrically connected to the grounding portion 30, to maintain potential balance of the grounding branch 21. To be specific, the feed branch 11 is coupled to the grounding branch 21, to excite the grounding portion 30. In this case, the induced current generated on the grounding portion 30 is parallel to the lateral side 221 in the first current mode 001. However, the feed branch 11 and the grounding branch 21 need to be located within a distance range that can sufficiently ensure coupling, so that the feed branch 11 is coupled to the grounding branch 21. Generally, the feed branch 11 and the grounding branch 21 are both relatively close to the insulating slot 50 and relatively far away from an end position of the gap 40. In this way, in the first current mode 001, an exciting position of the induced current excited on the grounding portion 30 after the feed branch 11 and the grounding branch 21 are coupled is away from the two end portions of the gap 40, so that the grounding portion 30 is excited at a position having largest characteristic current distribution in the first current mode 001. To be specific, the feed branch 11 and the grounding branch 21 can form a resonance to the current at a position having a relatively large induced current, so that the low frequency efficiency of the antenna 100 is higher and a clearance area needed by the antenna is smaller. In this way, the antenna 100 according to this application can obtain higher radiation efficiency and signal sending and receiving performance.

It can be understood that the mobile terminal may obtain a better call effect and a smaller area by using the antenna.

In an embodiment, the antenna 100 is applied to a typical circuit board of a mobile terminal. The circuit board 220 is a rectangle having a length of 150 mm and a width of 75 mm. Because a low band of the antenna 100 includes a 617-960 MHz band, most low band signals in the prior art are covered. It can be understood that the antenna 100 further includes LTE and GPS bands close to low frequencies, for example, an LTE B11/21/32 band (1427 MHz to 1511 MHz) and a GPS L1/L2/L5 band (1575.42 MHz/1227.6 MHz/1176.45 MHz).

In a specific implementation, the grounding portion 30, the feed stub 10, and the parasitic stub 20 jointly constitute electrical length that is a half of a wavelength of the operating frequency of the antenna, so that a resonance generated by the grounding portion 30, the feed stub 10, and the parasitic stub 20 excites an induced current that winds around the gap and that is a relatively large value. It can be understood that when the length of the gap is ¼ of the wavelength of the operating frequency, the length of the lateral side 221 is also ¼ of the wavelength of the transmit frequency, and the length of the radiation portion 210 is also roughly ¼ of the wavelength of the transmit frequency. Because the radiation portion 210 surrounds the lateral side 221, the length of the radiation portion 210 is slightly greater than that of the lateral side 221. In an embodiment, the radiation portion 210 and the lateral side 221 jointly constitute ½ of an asymmetric wavelength of a dipole of the antenna. Asymmetry herein means that the radiation portion 210 is slightly greater than the lateral side 221.

In this embodiment, the insulating slot 50 is disposed at a midpoint of a length direction of the radiation portion 210, that is, a midpoint of a length direction of the gap 40. To be specific, an electrical length of the feed stub 10 is the same as a length and a size of the parasitic stub 20. When the insulating slot 50 is located at a midpoint position of the length direction of the gap 40, this helps to symmetrically dispose the feed branch 11 and the grounding branch 21 on two sides of the insulating slot 50, so that when the feed branch 11 is coupled to the grounding branch 21, a midpoint of the coupling is just located at the gap 40, that is, a midpoint position of the lateral side 221. To be specific, a resonance exciting source of the antenna 100 is located at a midpoint position of the lateral side 221. It can be learned from the above description that when the antenna 100 is in the first current mode 001, a maximum value of the characteristic current of the antenna 100 is also located at the midpoint position of the lateral side 221. An exciting point of the grounding portion 30 after the feed branch 11 is coupled to the grounding branch 21 is located at a position having a largest exciting current on the grounding portion 30, so that better radiation efficiency can be obtained. It can be understood that to couple the feed branch 11 to the grounding branch 21, a relative distance between the feed branch 11 and the grounding branch 21 needs to satisfy an effective coupling effect between the feed branch 11 and the grounding branch 21.

For the insulating slot 50, to ensure that the feed stub 10 is coupled to the parasitic stub 20, the insulating slot 50 needs to be as narrow as possible, and the coupling between the feed branch 11 and the grounding branch 21 needs to be more matched, so that an antenna effect having better performance can be obtained. Therefore, a width range of the insulating slot 50, that is, a size in an extension direction of the gap 40 is properly set to be greater than or equal to 0.2 mm and less than or equal to 2 mm. To be specific, a size of the insulating slot 50 in the length direction of the radiation portion 210 is properly set to be greater than or equal to 0.2 mm and less than or equal to 2 mm. This is different from an existing antenna design. This is because in the existing antenna design, a coupling relationship between the antenna stubs mostly needs to be weakened as much as possible, to avoid mutual influence between the stubs. Therefore, a wider antenna gap is provided in most mobile terminals in the prior art. However, in the solution of the antenna 100 according to this application, the insulating slot 50 needs to be as narrow as possible, so that the mobile terminal 200 including the antenna 100 may have a smaller antenna split, improving appearance consistency of the mobile terminal 200.

It can be understood that the coupling between the feed branch 11 and the grounding branch 21 may further be controlled through a capacitance generated by two parallel planes formed by the insulating slot 50, that is, a cross-sectional area of the radiation portion 210 cut by the insulating slot 50. A same effect as that of adjusting the width of the insulating slot 50 can be realized by changing a cross-sectional area of the feed stub 10 and the parasitic stub 20 at the insulating slot 50, to adjust the coupling between the feed branch 11 and the grounding branch 21.

Figure 7A:
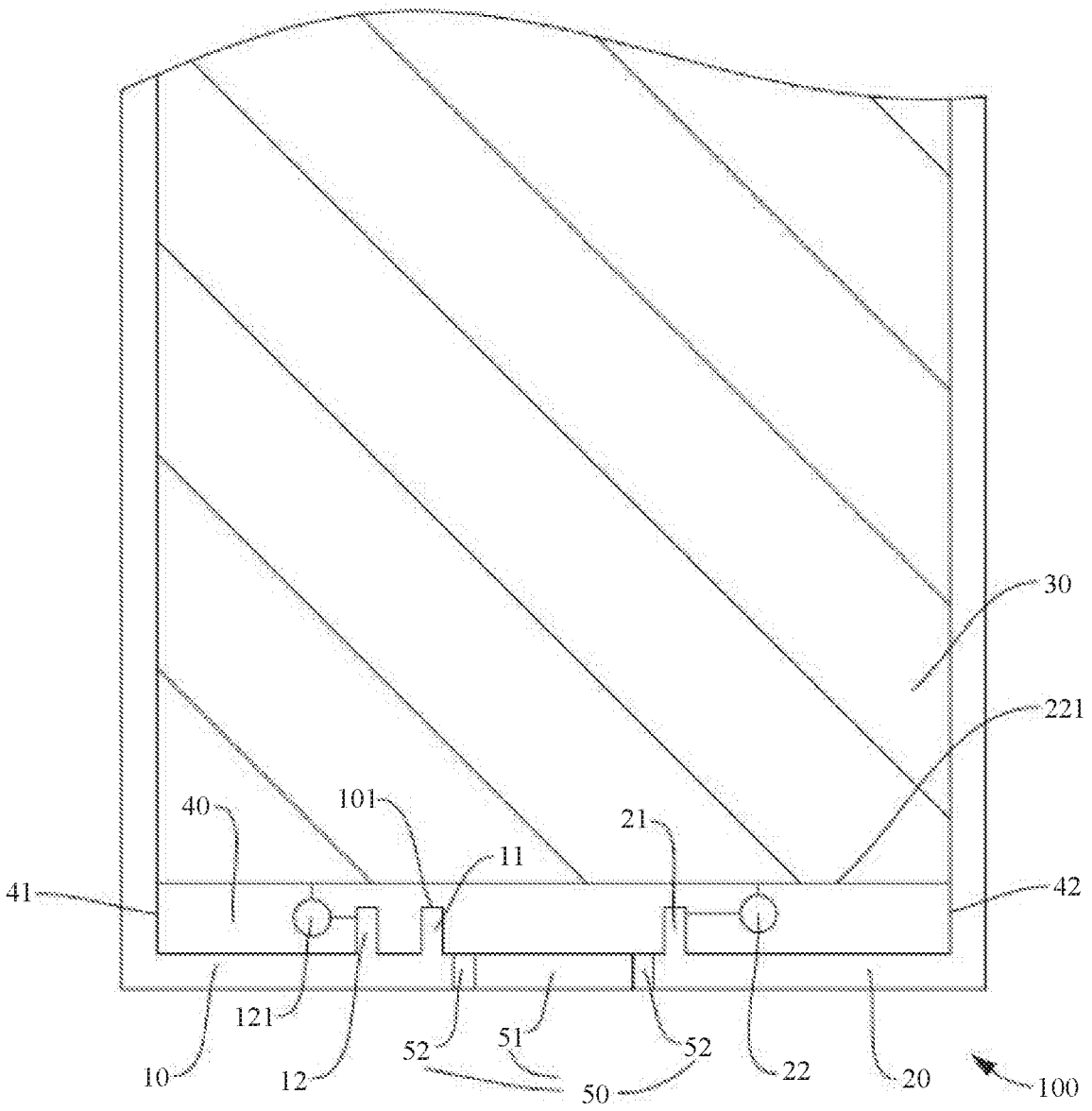
FIG. 7*a* is a schematic diagram of an embodiment of the antenna according to this application.

An embodiment is shown in FIG. 7*a*, and the insulating slot 50 in the embodiment shown in FIG. 7*a* includes a suspension section 51 made of a conductive material and a separation slot 52 on two sides of the suspension section 51. It can be understood that the suspension section 51 is located between the feed stub 10 and the parasitic stub 20. An insulating separation slot 52 is disposed between the suspension section 51 and the feed stub 10 and between the suspension section 51 and the parasitic stub 20. To be specific, the suspension section 51 is a section on the radiation portion 210, the suspension section 51 is located between the feed stub 10 and the parasitic stub 20, and the suspension section 51 and the separation slot 52 at two ends of the suspension section 51 jointly form the insulating slot 50, so that the feed stub 10 and the parasitic stub 20 are divided. The feed stub 10 passes through the separation slot 52 to feed the suspension section 51, and passes through the separation slot 52 to feed the parasitic stub 20 through the suspension section 51. After obtaining the parasitic current through the suspension section 51, the parasitic stub 20 is coupled to the feed stub 10, to provide a resonance exciting for the grounding portion 30. The suspension section 51 may be disposed as an external key or interface of the mobile terminal 200, such as, a structure of a charging interface or a USB interface of the mobile terminal 200. When the radiation portion 210 is a frame or a housing, this type of interface is mostly disposed on the radiation portion 210, and this type of interface is mostly directly formed as an opening on the radiation portion 210. A shape change of the radiation portion 210 at this type of interface is relatively large. Therefore, directly disposing the insulating slot 50 herein does not help a resonance design of the antenna 100. Instead, this type of key or interface is independently disposed as the suspension section 51, and the suspension section 51 is separated from the feed stub 10 and the parasitic stub 20 by the separation slot 52, so that the feed stub 10 and the parasitic stub 20 are both conductors of a relatively consistent shape, helping to simplify a model of the antenna 100 and realize more accurate feature matching design.

In another aspect, because the insulating slot 50 is at a midpoint position of the gap 40, and the suspension section 51 interferes with coupling between the feed branch 11 and the grounding branch 21 to some extent, the coupling becomes weak. In this case, the feed branch 11 and the grounding branch 21 both need to be disposed near the insulating slot 50. An end that is of the gap 40 and at which the feed stub 10 is electrically connected to the grounding portion 30 is defined as a first end 41, and the other end of the gap 40 is defined as a second end 42. It can be understood that the second end 42 is close to a position at which the parasitic stub 20 is electrically connected to the grounding portion 30. The feed branch 11 and the grounding branch 21 being disposed near the insulating slot 50 means that the feed branch 11 is closer to the insulating slot 50 relative to the first end 41, and the grounding branch 21 is also closer to the insulating slot 50 relative to the second end 42.

In an embodiment, a length range of the suspension section 51, that is, a size of the suspension section 51 in a length direction of the radiation portion 210, is set to be greater than or equal to 12 mm and less than or equal to 18 mm, and a length range of the separation slot 52, that is, a size of the separation slot 52 in the length direction of the radiation portion 210, is set to be greater than or equal to 0.2 mm and less than or equal to 1.5 mm. The length direction of the radiation portion 210 is a direction in which the radiation portion 210 extends from the feed stub 10 to the parasitic stub 20. This setting can ensure that the length of the suspension section 51 matches sizes of most keys or interfaces, and further ensure effective coupling between the grounding branch 21 and the feed branch 11.

A cyclic current is generated at the gap 40. In addition, a current also passes through the feed branch 11 and the grounding branch 21. In an embodiment, to ensure effective coupling between the grounding branch 21 and the feed branch 11, a length by which the grounding branch 21 extends to the gap 40 may be set to ¼ of a wavelength of an operating frequency of the antenna, a range of a length by which the feed branch 11 extends to the gap 40 is greater than or equal to ⅙ of the wavelength of the operating frequency of the antenna, and less than or equal to ⅛ of the wavelength of the operating frequency of the antenna, and a length by which the grounding branch extends to the gap is ¼ of the wavelength of the operating frequency of the antenna.

Specifically, when positions of the feed branch 11 and the first end 41 are fixed, an electrical length of the feed branch 11 is related to a distance between the feed point 101 and the insulating slot 50. Generally, in the embodiment shown in FIG. 7*a*, when the feed point 101 of the feed branch 11 is close to the insulating slot 50, the electrical length of the feed branch 11 is ⅛ to ⅙ (the range includes an endpoint) of the wavelength of the operating frequency of the antenna; when the feed point 101 of the feed branch 11 is far away from the insulating slot 50, the electrical length of the feed branch 11 may be understood as ¼ of the wavelength of the operating frequency of the antenna. A relative distance between the feed branch 11 and the insulating slot 50 and a length between the feed point 101 and the first end 41 may be adjusted to control and adjust the electrical length of the feed branch 11.

In an embodiment, because a length of the lateral side 221 is a fixed value, when a feeding current at the feed point 101 emits a signal of a corresponding resonance frequency, the grounding branch 21 generates a parasitic current of another resonance frequency. To ensure that impedance of the feeding current on the feed branch 11 and the parasitic current on the grounding branch 21 match each other, the grounding branch 21 may further be connected to a parasitic frequency modulation apparatus 22 in series at the grounding portion 30. The parasitic frequency modulation apparatus 22 is located between the grounding branch 21 and the grounding portion 30. It can be understood that a frequency modulation component common in the art, for example, a component such as a capacitor or an inductor may be used as the parasitic frequency modulation apparatus 22.

Correspondingly, the feed stub 10 may alternatively be provided with a feed frequency modulation branch 12. The feed frequency modulation branch 12 is in an extending direction in which the parasitic stub 21 faces the feed stub 11, that is, the feed frequency modulation branch 12 is located between the feed stub 11 and the first end 41. The feed frequency modulation branch 12 also extends to the gap 40, and the feed frequency modulation branch 12 is electrically connected to the grounding portion 30, to perform a grounding function of the feed stub 10.

In an embodiment, a feed frequency modulation apparatus 121 may be alternatively disposed between the feed frequency modulation branch 12 and the grounding portion 30, and is configured to adjust a frequency of the feed stub 10. It can be understood that the feed frequency modulation apparatus 121 may alternatively be a component such as a capacitor or an inductor.

Figure 8:
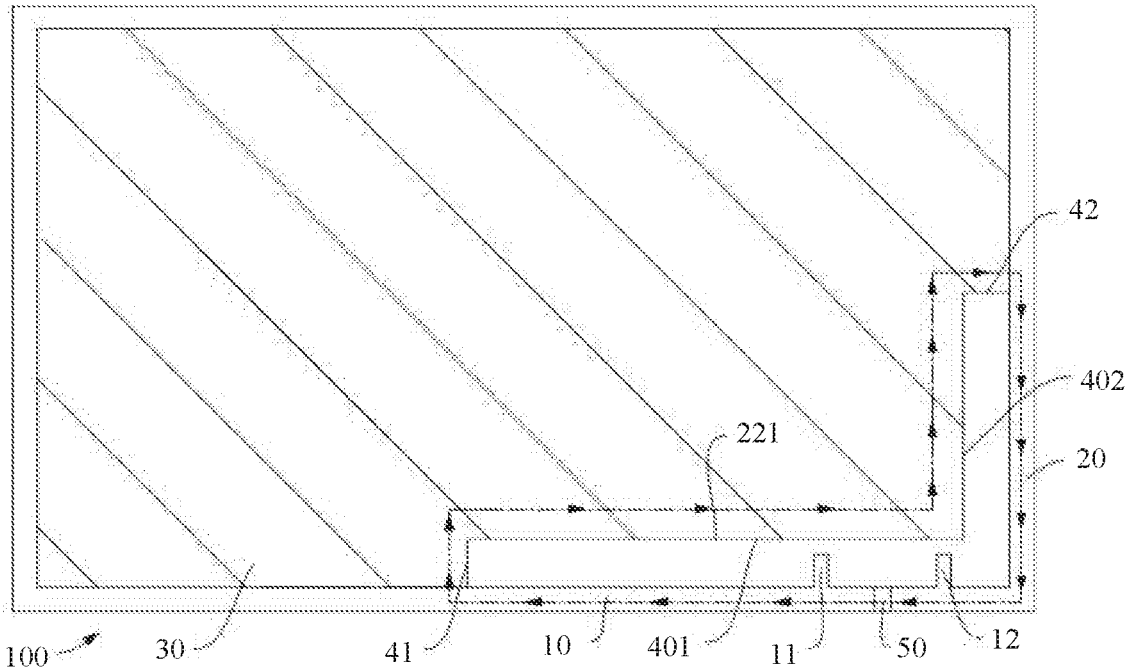
FIG. 8 is a schematic diagram of an embodiment of an antenna according to this application.

In terms of a typical circuit board of a mobile terminal, the circuit board 220 in this embodiment of this application is a rectangle having a length of 150 mm and a width of 75 mm. When the lateral side 221 is on a width (75 mm) side of the circuit board, an extended length of the lateral side 221 in this direction does not exceed a maximum of 75 mm. For a low-frequency resonance of the antenna, the lateral side 221 is required to have a relatively large length to match an electrical length of a ¼ wavelength. Therefore, when the lateral side 221 is on a single edge of the mobile terminal 200, and a length of the single edge cannot sufficiently match the ¼ wavelength required by a low frequency of the mobile terminal 200, the lateral side 221 needs to be extended. That is, the length of the lateral side 221 is increased to match the electrical length required by the frequency. Correspondingly, extension of the lateral side 221 drives the radiation portion 210 to extend, and the gap 40 correspondingly increases as the lateral side 221 and the radiation portion 210 extend (as shown in FIG. 8). The lateral side 221 is in a shape of a folded side, the lateral side 221 in the shape of a folded side includes a first segment 401 and a second segment 402 that intersect with each other, and an end of the first segment 401 and an end of the second segment 402 coincide. Correspondingly, the first end 41 of the gap 40 is located at an end of the first segment 401, and the second end 42 is located at an end of the second segment 402. The feed stub 10 or the parasitic stub 20 also bends synchronously along with the lateral side 221, to maintain a consistent cross-sectional width of the gap 40 in a length extension direction. After the shape of the gap 40 changes, a current cyclic loop of the antenna 100 during feeding still proceeds around the gap 40. In this case, a start position of an induced current of the antenna 100 depends on a coupling position of the feed stub 10 and the parasitic stub 20. To be specific, when the coupling position of the feed stub 10 and the parasitic stub 20 appears in the first segment 401, the start position of the induced current on the grounding portion 30 is the coupling position corresponding to the first segment 401. When the coupling position of the feed stub 10 and the parasitic stub 20 appears in the second segment 402, the start position of the induced current on the grounding portion 30 is the coupling position corresponding to the second segment 402. It can be understood that regardless of any position of the induced current on the grounding portion 30, a flowing path of the induced current proceeds around the gap 40. In this case, a length sum of the first segment 401 and the second segment 402 is set to be equal to a ¼ wavelength of a low-frequency midpoint of the mobile terminal 200, so that the antenna 100 can effectively generate a low-frequency resonance.

In this disposing manner, the antenna 100, including the position of the insulating slot 50 in the mobile terminal 200, is disposed relatively flexibly. However, in an existing antenna technology, radiation bodies of a mobile terminal are mostly metal frames and include a metal rear cover, and radiation is implemented by providing a gap on the frame. In this disposing manner, when a user makes a call in a head-hand mode, because a hand of the person holds the metal frame and the metal rear cover, efficiency attenuation of the antenna is caused. Particularly, when the hand holds a gap of the metal frame, performance attenuation of the antenna is serious, deteriorating communication performance.

Therefore, an antenna split is provided at a bottom portion of most rectangular mobile terminals 200, to avoid a direct contact between a human hand and the split. In this case, an antenna feed point excites a current of a longer side direction of a circuit board to perform radiation, that is, the second current mode 002 of this application. It can be learned from the above descriptions that in the second current mode 002, a characteristic current of the antenna 100 is just a smallest value at a position closest to the feed point 101. In this way, excited antenna radiation efficiency is lower. In an embodiment, because a split of the mobile terminal in a head-hand mode is still close to a position at which the user holds the mobile terminal, attenuation of the antenna in the head-hand mode is more serious in the prior art. Generally, a low frequency reduction of the antenna in the prior art is at least greater than 6 dB.

However, for the antenna 100 of this application, on the one hand, because a position of the antenna 100 of this application is not limited by a wavelength of a low frequency, the antenna 100 is relatively flexibly disposed. In theory, the antenna 100 may be disposed at any position around the mobile terminal 200. Correspondingly, the insulating slot 50 may also be disposed at any position of an edge of the mobile terminal 200. Coverage of the antenna by a palm of a user in the head-hand mode may be reduced to the lowest. On the other hand, because the antenna 100 of this application uses the first current mode 001 to perform exciting, exciting efficiency of the antenna 100 is higher, and a signal attenuation problem of the antenna 100 in the head-hand mode can be avoided to a great extent. It can be learned from a test that when the insulating slot 50 is disposed at a bottom position of the mobile terminal 200, a low frequency reduction of the antenna 100 of this application in the head-hand mode is controlled to be within 3 dB.

It should be noted that the antenna 100 is disposed at a bottom portion of the mobile terminal 200. In this embodiment of this application, this is defined as follows: the lateral side 221 is located at a bottom end of a default display picture of the display surface 240 of the mobile terminal 200, that is, a bottom end of the mobile terminal 200 when the user watches the mobile terminal 200 from a font view. When a typical circuit board 220 of a rectangular shape having a length of 150 mm and a width of 75 mm is used for the mobile terminal 200, when the user holds the mobile terminal 200 and enters a head-hand mode, a bottom position of the mobile terminal 200 usually is not covered and is in a relative open and free status. Therefore, the antenna 100 is disposed at the bottom end of the mobile terminal 200, to facilitate signal receiving of the antenna.

According to another aspect, in existing mobile terminal products, structures such as a charging interface and a USB interface are mostly disposed at a bottom portion of the mobile terminal. In an embodiment in which the insulating slot 50 in the antenna 100 of this application further includes the suspension section 51, 20 interface design of the mobile terminal 200 of this application is also facilitated.

Figure 9:
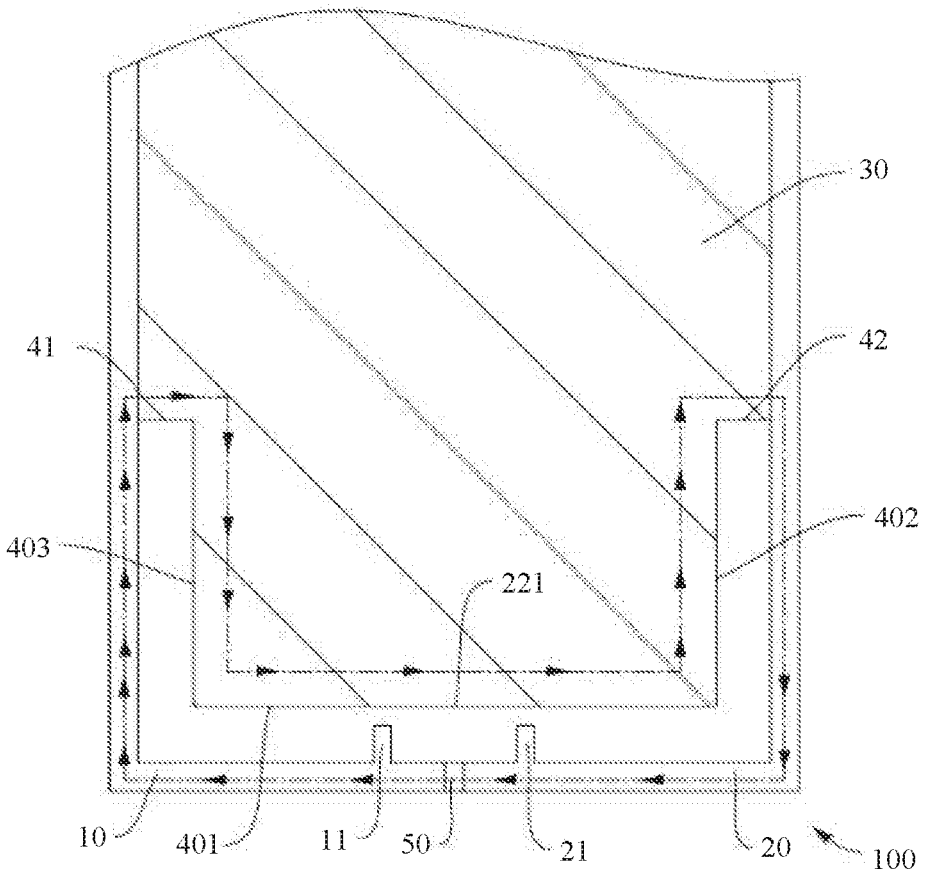
FIG. 9 is a schematic diagram of an embodiment of an antenna according to this application.

An embodiment is shown in FIG. 9. A folded side of the lateral side 221 further includes a third segment 403. The third segment 403 is located at an end that is of the first segment 401 and that is far away from the second segment 402, and the third segment 403 also intersects with the first segment 401. To be specific, the first segment 401 is connected between the second segment 402 and the third segment 403, and the second segment 402 and the third segment 403 bend in a same direction from the first segment 401. Similarly, the feed stub 10 or the parasitic stub 20 bends synchronously along with the lateral side 221, and the feed stub 10 or the parasitic stub 20 also includes two intersected shapes, to maintain a consistent cross-section width of the gap 40 in a length extension direction. It can be understood that the first end 41 of the gap 40 in this embodiment is located at an end that is of the third segment 403 and that is far away from the first segment 401, and the second end 42 is located at an end that is of the second segment 402 and that is far away from the first segment 401. With introduction of the third segment 403, a length of the gap 40 can further be extended. In this way, when a length of a lateral side of the grounding portion 30 in a specific direction is insufficient, introduction of the third segment 403 helps, through matched design of the third segment 403 and the second segment 402, to dispose the insulating slot 50 at a position of a lateral frame that is of the mobile terminal 200 and that corresponds to the lateral side wall. Further, when a length of the third segment 403 is the same as that of the second segment 402, the insulating slot 50 may be located in a middle portion of a lateral frame of the mobile terminal 200. When the structure such as the charge interface or the USB interface is disposed on the mobile terminal 200, a corresponding interface structure is disposed on a lateral side of the mobile terminal 200, for example, a middle portion of a bottom side.

It should be noted that the intersection between the first segment 401 and the second segment 402 and the intersection between the third segment 403 and the first segment 401 is vertical intersection shown in FIG. 9. In some other embodiments, the intersection between the first segment 401 and the second segment 402 and the intersection between the third segment 403 and the first segment 401 may be disposed, based on a different shape of the circuit board 220 or a different shape of the radiation portion 210, as intersection of any other angles or shapes such as intersection of curves and intersection of a plurality of straight line segments. As long as the length of the gap 40 can be extended effectively to match a wavelength required by a resonance frequency, the technical solutions claimed by this application can be implemented.

Figure 7B:
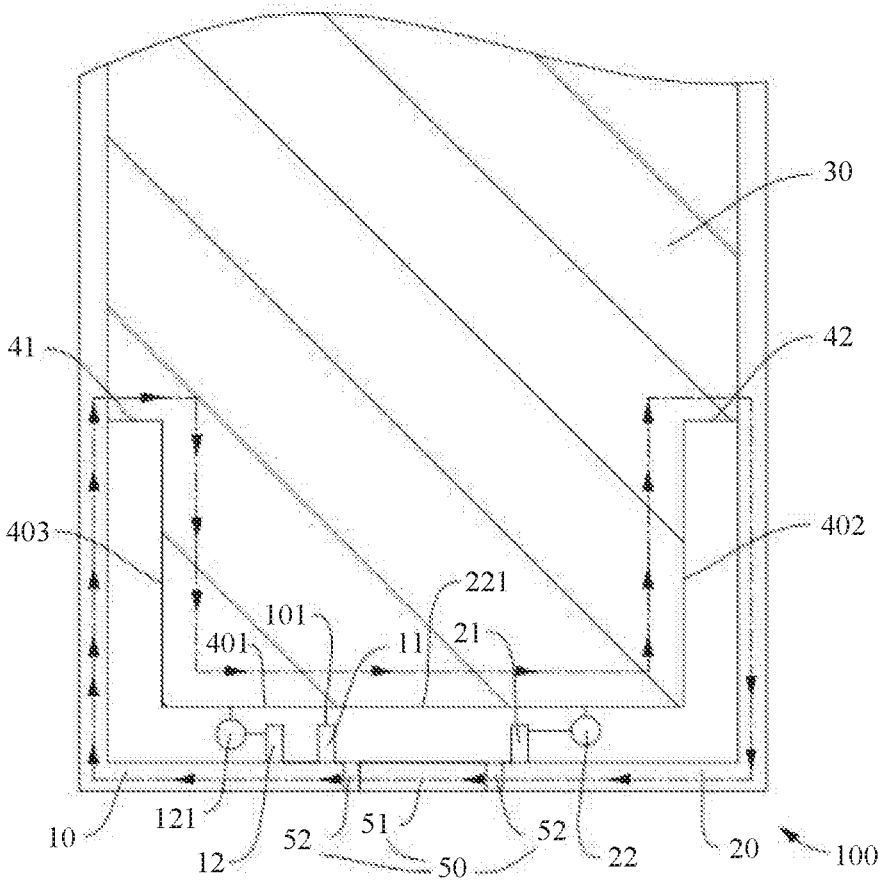
FIG. 7*b* is a schematic diagram of an embodiment of the antenna according to this application.

Referring to the embodiment shown in FIG. 7*b* again and with reference to features of the two embodiments shown in FIG. 7*a* and FIG. 9, the lateral side 221 of the antenna 100 includes the second segment 402 and the third segment 403, and the insulating slot 50 also includes the suspension section 50 and the separation slot 52. The embodiment shown in FIG. 7*b* is applicable to a case in which on a shorter lateral side of the mobile terminal 200, an interface needs to be disposed at an opening provided at a middle position of the shorter lateral side.

Figure 10:
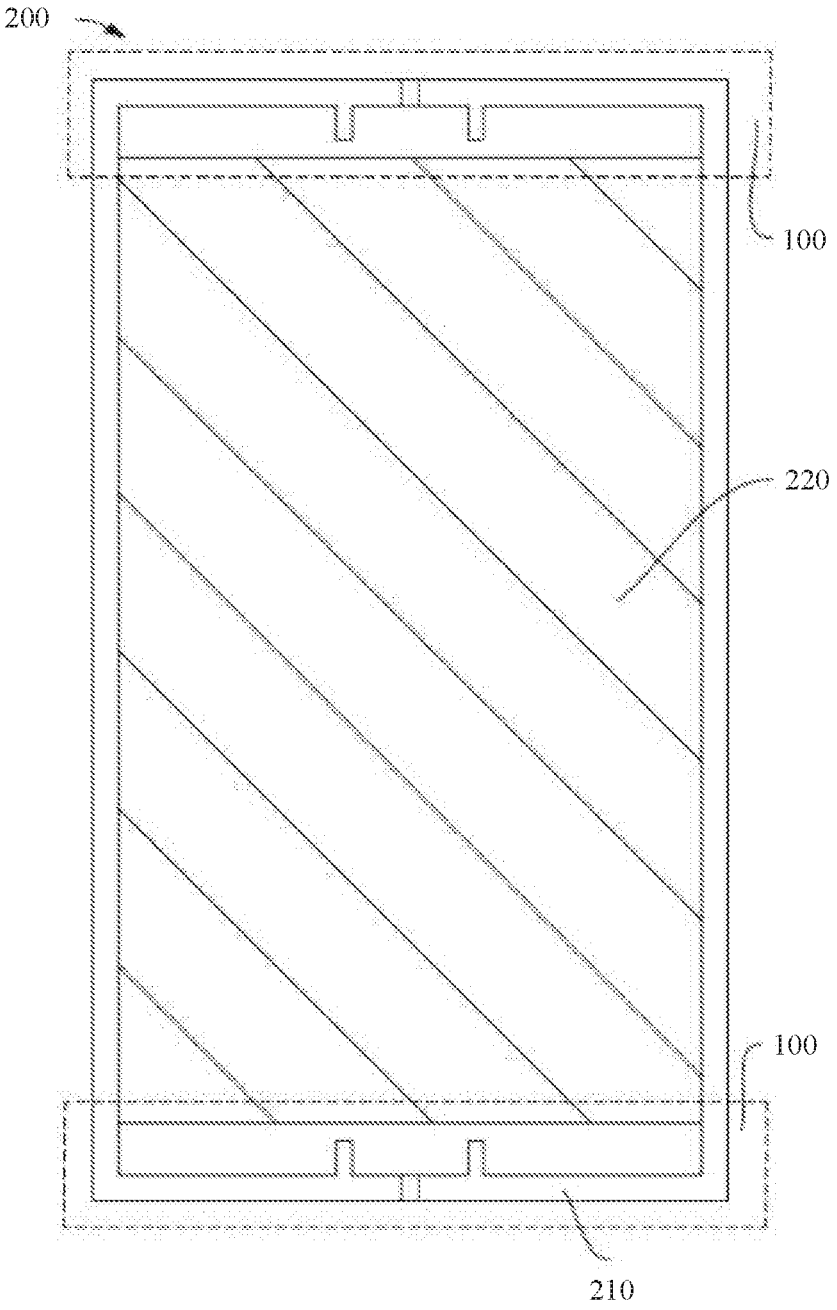
FIG. 10 is a schematic diagram of an embodiment of a mobile terminal according to this application.

In an embodiment shown in FIG. 10, the antenna 100 is disposed on both a top surface and a bottom surface of the mobile terminal 200, and the two antennas 100 may be in a same frequency band or may be set to be in different frequency bands that can switch automatically. A communication capability of the mobile terminal 200 can be further strengthened by disposing the two antennas 100.

Figure 11:
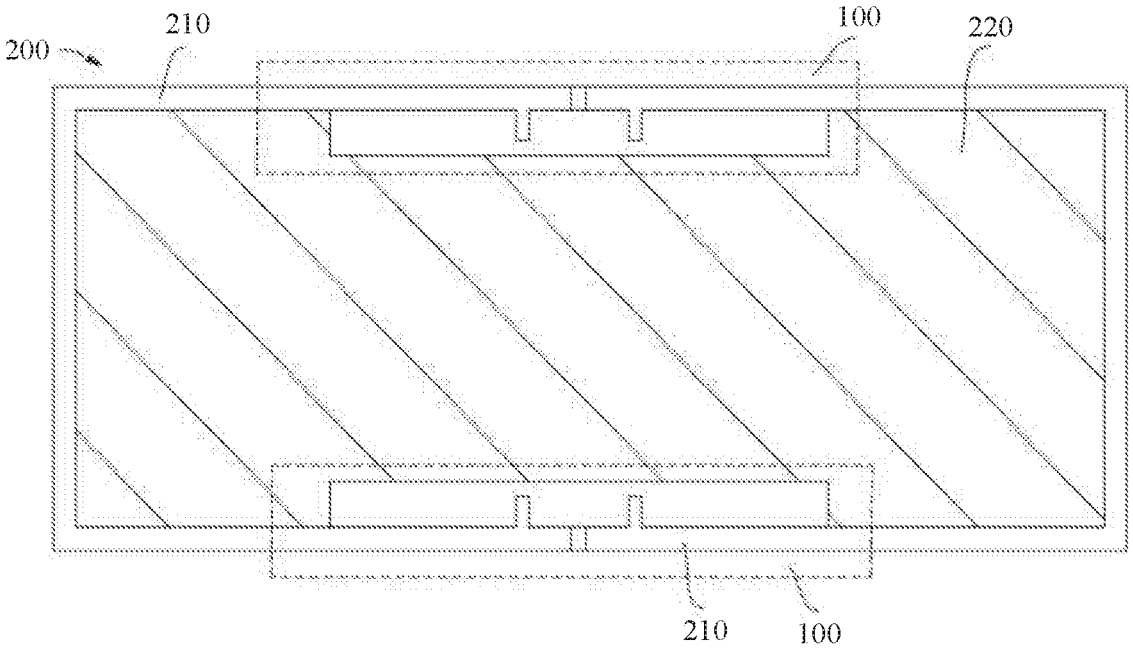
FIG. 11 is a schematic diagram of an embodiment of a mobile terminal according to this application.

For ease of understanding, the embodiment of the antenna 100 of this application is described by using a typical circuit board of a mobile terminal. However, it can be learned from the specification of this application that the mobile terminal 200 of this application is not limited to a mobile phone, and may further include an intelligent device having a network function such as a tablet computer, an e-reader, a remote control, a notebook computer, a vehicle-mounted device, a web television, or a wearable device. Therefore, the circuit board 220 of the mobile terminal 200 of this application may further have any size that can match the above product structure. The antenna 100 of this application may further be disposed at any edge position of the mobile terminal 200 according to actual situations. For example, in the embodiment shown in FIG. 11, the mobile terminal 200 is a tablet computer, and the user easily holds two sides of the tablet computer with both the left hand and the right hand when holding the tablet computer. In this case, the antenna 100 is disposed at both a top portion and a bottom portion of the mobile terminal 200, so that a better communication effect can be implemented when the user holds the tablet computer. It can be understood that the antenna 100 is located at a position of a longer lateral side of the mobile terminal 200, and this is different from the above embodiment in which the antenna 100 is located at a position of a shorter lateral side of the mobile terminal 200.

Figure 12:
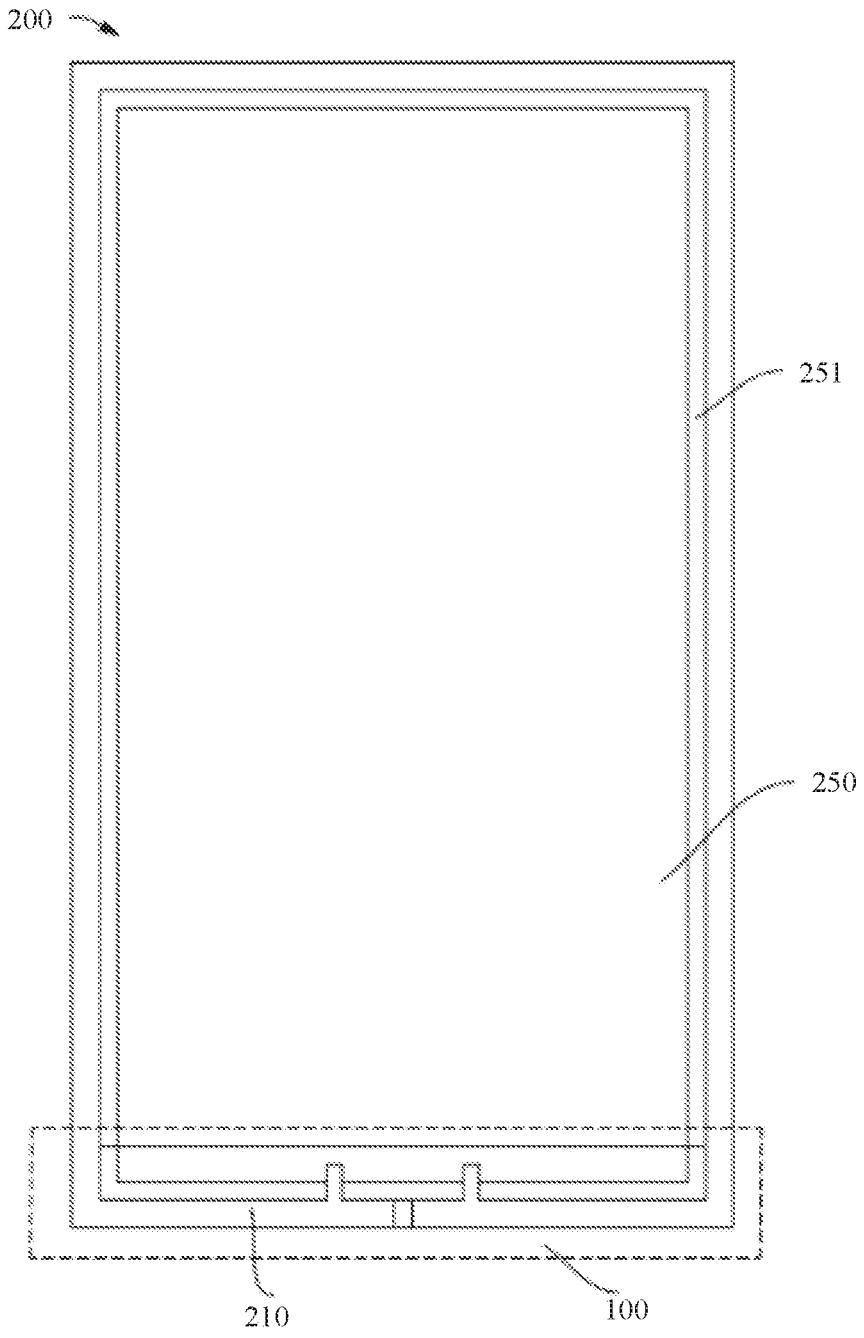
FIG. 12 is a schematic diagram of an embodiment of a mobile terminal according to this application.

In the above embodiments, the radiation portion 210 of the mobile terminal 200 may be a metal side frame structure of the mobile terminal 200, or may be a metal middle frame structure of the mobile terminal 200. In this case, a rear cover 250 of the mobile terminal 200 is properly made of a non-conductive material such as glass or plastic, and the radiation portion 210 is relatively independent and surrounds at least a segment of the circuit board 220, so that the technical solution of the antenna 100 of this application is implemented. However, in some embodiments of the rear cover 250 using only a metal, the method shown in FIG. 12 may be used. A circle of separation 251 is disposed on the rear cover 250 of the mobile terminal 200, and an edge of the rear cover 250 is separated by the separation 251 to form a segment of the radiation portion 210, where a part is used as the radiation portion 210 in the antenna 100 for radiation.

In some other embodiments, the rear cover 250 is made of a non-conductive material, the radiation portion 210 is disposed in the rear cover 250 in a manner of laser direct structuring (LDS), insert molding (insert molding), or the like, and is in communication with the grounding portion 30 through the rear cover 250, so that a technical effect of the antenna of this application can be realized similarly. Alternatively, the radiation portion 210 is a flexible printed circuit board (FPC) electrically connected to the grounding portion 30.

The foregoing implementations are not intended to limit the protection scope of the technical solutions. Any modification, equivalent replacement, and improvement made without departing from the principle of the foregoing implementations shall fall within the protection scope of the technical solutions.

What is claimed is:

1. A mobile terminal, comprising:
a metal frame;
a circuit board comprising a grounding layer and a lateral side; and
a first antenna comprising:
a radiation portion comprising:
a feed stub;
a parasitic stub;
a conductive suspension section located between the feed stub and the parasitic stub and comprising a first end and a second end opposite the first end, wherein the feed stub is proximate to the first end and the parasitic stub is proximate to the second end;
a first insulating slot disposed between the conductive suspension section and the feed stub; and
a second insulating slot disposed between the conductive suspension section and the parasitic stub,
wherein a gap is formed between the radiation portion and the lateral side,
wherein the radiation portion is a part of the metal frame;
a grounding portion electrically coupled to a first end of a first frequency modulation apparatus, wherein the first frequency modulation apparatus comprises a capacitor or an inductor, wherein the grounding portion comprises at least a part of the grounding layer, wherein an end of the feed stub that is away from the first insulating slot is electrically coupled to the grounding portion, and wherein an end of the parasitic stub that is away from the second insulating slot is electrically coupled to the grounding portion;
a first branch extending from the feed stub to the gap, wherein an end of the first branch that is away from the feed stub is a feed point; and
a second branch extending from the parasitic stub to the gap and is electrically coupled to a second end of the first frequency modulation apparatus.

2. The mobile terminal of claim 1, wherein the feed stub is configured to generate a first resonance frequency, and wherein the parasitic stub is configured to generate a second resonance frequency.

3. The mobile terminal of claim 2, wherein the first resonance frequency and the second resonance frequency are two approximate resonance frequencies.

4. The mobile terminal of claim 1, wherein a current is configured to pass through the lateral side, the feed stub, and the parasitic stub to form a current loop cycling around the gap.

5. The mobile terminal of claim 1, wherein a size range of the conductive suspension section along a length direction of the radiation portion is greater than or equal to 12 millimeters (mm) and less than or equal to 18 mm, and wherein a size range of the first insulating slot or the second insulating slot along the length direction of the radiation portion is greater than or equal to 0.2 mm and less than or equal to 1.5 mm.

6. The mobile terminal of claim 1, wherein the antenna further comprises a third branch extending from the feed stub to the gap and is electrically coupled to a first end of a second frequency modulation apparatus, wherein a second end of the second frequency modulation apparatus is electrically coupled to the grounding portion, and wherein the second frequency modulation apparatus comprises a second capacitor or a second inductor.

7. The mobile terminal of claim 1, wherein the conductive suspension section is disposed as a structure of a charging interface or a universal serial bus (USB) interface of the mobile terminal.

8. The mobile terminal of claim 1, wherein the first insulating slot, the conductive suspension section, and the second insulating slot are disposed at a middle portion of a bottom side of the mobile terminal.

9. The mobile terminal of claim 1, wherein the lateral side comprises a first segment, a second segment, and a third segment, wherein both the second segment and the third segment intersect with the first segment, wherein the first segment is coupled between the second segment and the third segment, wherein the second segment and the third segment bend in a same direction from the first segment, wherein the feed stub bends along with the third segment, and wherein the parasitic stub bends along with the second segment.

10. The mobile terminal of claim 1, wherein a first distance is between the first insulating slot and a first portion coupling the first branch and the feed stub, wherein a second distance is between the first portion and a position at which the feed stub is electrically coupled to the grounding portion, wherein the first distance is less than the second distance, wherein a third distance is between the second insulating slot and a second portion coupling the second branch and the parasitic stub, wherein a fourth distance is between the second portion and a position at which the parasitic stub is electrically coupled to the grounding portion, and wherein the third distance is less than the fourth distance.

11. A mobile terminal, comprising:
a metal frame;
a circuit board comprising a grounding layer and a lateral side, wherein the lateral side is in a shape of a folded side; and
an antenna comprising:
a radiation portion comprising:
a feed stub;
a parasitic stub; and
an insulating slot located between the feed stub and the parasitic stub such that the feed stub and the parasitic stub are disposed proximate to opposing sides of the insulating slot,
wherein the feed stub or the parasitic stub bends along with the lateral side,
wherein a gap is formed between the radiation portion and the lateral side,
wherein the radiation portion is a part of the metal frame;
a grounding portion electrically coupled to a first end of a parasitic frequency modulation apparatus, wherein the parasitic frequency modulation apparatus comprises a capacitor or an inductor, wherein the grounding portion comprises at least a part of the grounding layer, wherein an end of the feed stub that is away from the insulating slot is electrically coupled to the grounding portion, wherein an end of the parasitic stub that is away from the insulating slot is electrically coupled to the grounding portion;
a first branch extending from the feed stub to the gap, wherein an end of the first branch that is away from the feed stub is a feed point; and
a second branch extending from the parasitic stub to the gap and is electrically coupled to a second end of the parasitic frequency modulation apparatus.

12. The mobile terminal of claim 11, wherein the feed stub is configured to generate a first resonance frequency, and wherein the parasitic stub is configured to generate a second resonance frequency.

13. The mobile terminal of claim 12, wherein the first resonance frequency and the second resonance frequency are two approximate resonance frequencies.

14. The mobile terminal of claim 11, wherein a current is configured to pass through the lateral side, the feed stub and the parasitic stub to form a current loop cycling around the gap.

15. The mobile terminal of claim 11, wherein a size range of the insulating slot along a length direction of the radiation portion is greater than or equal to 0.2 millimeters (mm) and less than or equal to 2 mm.

16. The mobile terminal of claim 11, wherein the antenna further comprises a third branch extending from the feed stub to the gap and is electrically coupled to a first end of a second frequency modulation apparatus, wherein a second end of the second frequency modulation apparatus is electrically coupled to the grounding portion, and wherein the second frequency modulation apparatus comprises a second capacitor or a second inductor.

17. The mobile terminal of claim 11, wherein the lateral side comprises a first segment, a second segment, and a third segment, wherein both the second segment and the third segment intersect with the first segment, wherein the first segment is coupled between the second segment and the third segment, wherein the second segment and the third segment bend in a same direction from the first segment, wherein the feed stub bends along with the third segment, and wherein the parasitic stub bends along with the second segment.

18. The mobile terminal of claim 11, wherein a first distance is between the insulating slot and a first portion coupling the first branch and the feed stub, wherein a second distance is between the first portion and a position at which the feed stub is electrically coupled to the grounding portion, wherein the first distance is less than the second distance, wherein a third distance is between the insulating slot and a second portion coupling the second branch and the parasitic stub, wherein a fourth distance is between the second portion and a position at which the parasitic stub is electrically coupled to the grounding portion, and wherein the third distance is less than the fourth distance.

19. A mobile terminal, comprising:

a metal frame;

a circuit board comprising a grounding layer and a lateral side; and an antenna comprising:

a radiation portion comprising:

a feed stub;

a parasitic stub; and an insulating slot located between the feed stub and the parasitic stub such that the feed stub and the parasitic stub are disposed proximate to opposing sides of the insulating slot, wherein the insulating slot is disposed at a top side of the mobile terminal, wherein a gap is formed between the radiation portion and the lateral side of the circuit board, wherein the radiation portion is a part of the metal frame;

a grounding portion electrically coupled to a first end of a parasitic frequency modulation apparatus, wherein the parasitic frequency modulation apparatus comprises a capacitor or an inductor, wherein the grounding portion comprises at least a part of the grounding layer, wherein an end of the feed stub that is away from the insulating slot is electrically coupled to the grounding portion, and wherein an end of the parasitic stub that is away from the insulating slot is electrically coupled to the grounding portion;

a first branch extending from the feed stub to the gap, wherein an end of the first branch that is away from the feed stub is a feed point; and a second branch extending from the parasitic stub to the gap and is electrically coupled to a second end of the parasitic frequency modulation apparatus.

20. The mobile terminal of claim 19, wherein the feed stub is configured to generate a first resonance frequency, and wherein the parasitic stub is configured to generate a second resonance frequency.

* * * * *